United States Patent [19]

Shiba et al.

[11] 4,021,248

[45] May 3, 1977

[54] COLOR PHOTOGRAPHIC LIGHT-SENSITIVE MATERIAL

[75] Inventors: Keisuke Shiba; Kiyoshi Nakazyo; Reiichi Ohi; Keiichi Adachi, all of Minami-ashigara, Japan

[73] Assignee: Fuji Photo Film Co., Ltd., Minami-ashigara, Japan

[22] Filed: Sept. 3, 1975

[21] Appl. No.: 610,014

[30] Foreign Application Priority Data

Sept. 3, 1974 Japan ..... 49-101678

[52] U.S. Cl. ..... 96/100; 96/55; 96/56; 96/56.5; 96/109

[51] Int. Cl.[2] ..... G03C 1/40; G03C 7/00

[58] Field of Search ..... 96/100, 109, 56

[56] References Cited

UNITED STATES PATENTS

| | | | |
|---|---|---|---|
| 2,956,876 | 10/1960 | Spath | 96/56 |
| 3,305,362 | 2/1967 | Riester et al. | 96/109 |
| 3,637,393 | 1/1972 | Sakamoto et al. | 96/109 |
| 3,692,527 | 9/1972 | Konig et al. | 96/100 |
| 3,819,379 | 6/1974 | Ohyama et al. | 96/109 |
| 3,930,866 | 1/1976 | Oishi et al. | 96/100 |
| 3,945,829 | 3/1976 | Zorn et al. | 96/109 |

*Primary Examiner*—J. Travis Brown
*Attorney, Agent, or Firm*—Sughrue, Rothwell, Mion, Zinn & Macpeak

[57] ABSTRACT

A color photographic light-sensitive material comprising a silver halide photographic emulsion containing (1) at least one compound selected from the group consisting of (a) a compound represented by the following general formula (I);

$$Cp - Z \qquad (I)$$

wherein Cp represents a monovalent residue of a magenta or yellow coupler residue in which one hydrogen atom of the active methylene group is replaced by a coupling off group Z eliminated upon coupling reaction with an oxidation product of an aromatic primary amine color developing agent, and Z represents a nitrogen-containing coupling-off group connected to Cp at a nitrogen atom thereof, and (b) a 4-position unsubstituted 3-arylamino-5-pyrazolone derivative, and (2) at least one compound represented by the following general formula (II);

$$Q - SH \qquad (II)$$

wherein Q represents a heterocyclic group, bonded directly or indirectly thereto and containing at least one of a $-SO_3H$ group, a $-COOH$ group, an $-OH$ group and a $-NHR$ group, where R represents a hydrogen atom or an alkyl group having 1 to 6 carbon atoms.

40 Claims, 1 Drawing Figure

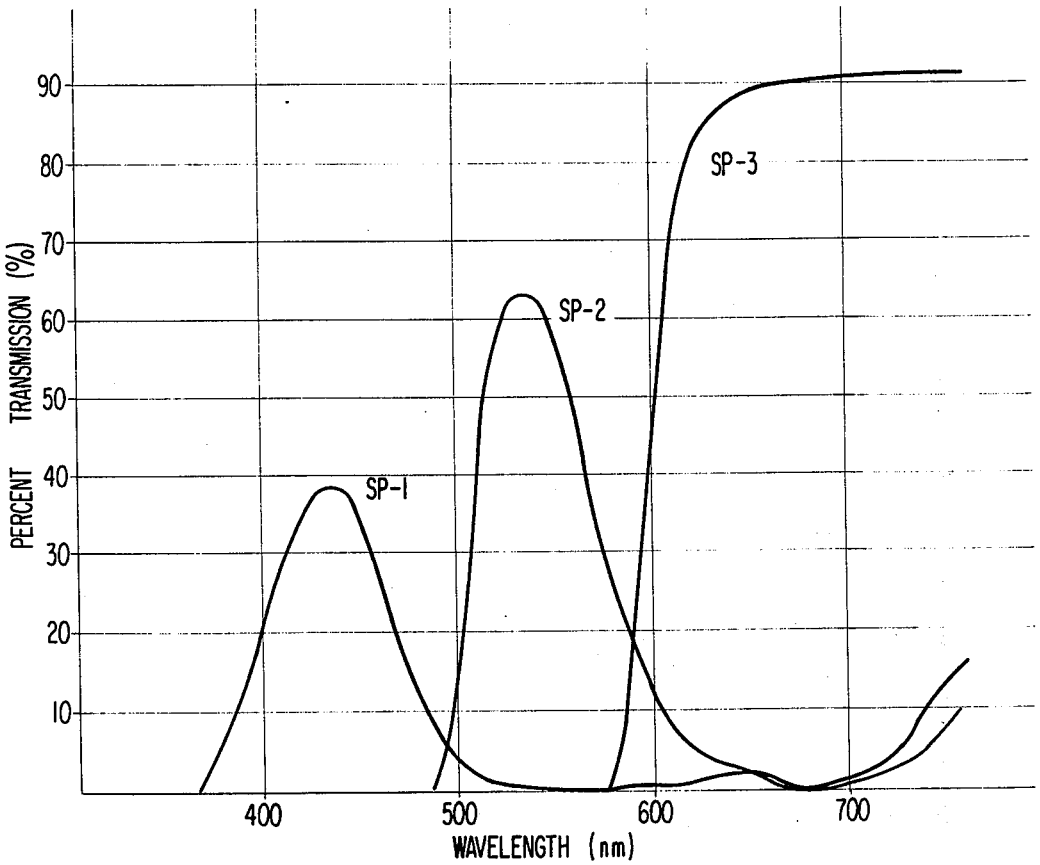
PERCENT TRANSMISSION (%)
90
80
70
60
50
40
30
20
10
SP-1
SP-2
SP-3
400
500
600
700
WAVELENGTH (nm)

COLOR PHOTOGRAPHIC LIGHT-SENSITIVE MATERIAL

BACKGROUND OF THE INVENTION

1. Field of the Invention

The present invention relates to a color photographic light-sensitive material providing color images with improved fastness and improved sharpness and capable of being rapidly processed at an elevated temperature and, more particularly, to a color photographic light-sensitive material in which fogging caused by development at an elevated temperature, for example, above about 30° C, can be controlled and which has improved stability.

2. Description of the Prior Art

In recent years, it has eagerly been desired to provide a color light-sensitive material capable of being developed rapidly, for example, in a short time of less than 6 minutes, particularly less than 3 minutes. For this purpose, various techniques have been tried. For example, silver halide grains exhibiting a rapid color development rate, i.e., silver bromoiodide or silver bromochloride grains or silver halide grains obtained by conversion have been used, couplers permitting rapid color development alone or in combination have been used, or an accelerator for color development or a sensitizer, e.g., onium salts, polyoxyethylene residue-containing compounds, 3-pyrazolidone derivatives, imidazole compounds, and compounds capable of releasing a development accelerator upon development have been used.

On the other hand, various techniques have also been tried in the development processing step. For example, development processing at an elevated temperature, particularly about 30° C or above, or use of a color developing agent exhibiting a rapid developing rate, use of a development accelerator, employing blix processing, applying a process for obtaining color images through a combined developing processing, or the like have been attempted.

Furthermore, another technique is to use couplers allowing a reduction in the content of silver halide necessary for forming color images, e.g., 2-equivalent couplers. Couplers in accordance with this purpose are not necessarily 2-equivalent couplers, and 4-equivalent 3-anilino-5-pyrazolone couplers exhibiting good coloring efficiency are also usable. Also, the so-called colored couplers wherein one hydrogen atom of the active methylene group is replaced by an azo group are also useful as magenta couplers. Of the 2-equivalent couplers, those wherein a nitrogen atom of the coupler off group is connected to a carbon atom of the active methylene group are particularly useful for this purpose.

When color light-sensitive materials to which the above-described various techniques have been applied are subjected to rapid processing, fog tends to be formed. In particular, when these materials are rapidly developed at an elevated temperature, fogging tends to occur. Various techniques can be used for controlling fogging in color development. For example, phenol derivatives, in particular, hydroquinone derivatives, mercapto compounds such as 1-phenyl-5-mercaptotetrazole, 5-nitrobenzotriazole, 2-mercaptobenzimidazole, etc., and other heterocyclic compounds capable of forming silver salts can be used. These compounds, however, produce in turn new disadvantages in that they desensitize the silver halide emulsion, deteriorate the gradation (gamma), or gradually reduce the sensitivity with the lapse of time.

SUMMARY OF THE INVENTION

An object of the present invention is to remove these defects of the prior art.

In particular, an object of the present invention is to provide a color photographic light-sensitive material in which fog formation upon development processing at an elevated temperature, in particular at about 30° C or above, can be controlled.

Another object of the present invention is to provide a color light-sensitive material containing a 2-equivalent magenta or yellow coupler or a 4-equivalent 3-anilino-5-pyrazolone coupler, in which fog formation upon processing at a high temperature can be controlled.

A further object of the present invention is to provide a light-sensitive material which has improved storability and in which fogging is controlled.

Still a further object of the present invention is to provide a color photographic light-sensitive material in which fogging on processing at an elevated temperature is controlled by using a 2-equivalent magenta or yellow coupler or a 4-equivalent 3-anilino-5-pyrazolone coupler and a heterocyclic mercapto compound in combination, or additionally using a hydroquinone derivative, and which has improved storability before being exposed.

The above-described objects are attained with a color photographic light-sensitive material comprising a silver halide photographic emulsion containing (1) at least one compound selected from the group consisting of (a) a compound represented by the following general formula (I);

$$Cp - Z \qquad (I)$$

wherein Cp represents a monovalent magenta or yellow coupler residue in which one hydrogen atom of the active methylene group is replaced by a coupling off group Z eliminated upon coupling reaction with an oxidation produce of an aromatic primary amine color developing agent, and Z represents a nitrogen containing coupling-off group connected to Cp at a nitrogen atom thereof, and (b) a 3-arylamino-5-pyrazolone derivative in which the 4-position thereof is unsubstituted, and (2) at least one compound represented by the following general formula (II);

$$Q - SH \qquad (II)$$

wherein Q represents a heterocyclic group bonded directly or indirectly thereto and containing at least one group selected from the group consisting of a $—SO_3H$ group, a —COOH group, a —OH group and a —NHR group, where R represents a hydrogen atom or an alkyl group having 1 to 6 carbon atoms.

BRIEF DESCRIPTION OF THE ACCOMPANYING DRAWING

The FIGURE shows the percent transmission for the red, blue and green filters employed in the examples.

DETAILED DESCRIPTION OF THE INVENTION

The coupling off group as used in the description of the present invention means a nitrogen-containing group which is to be eliminated upon the coupling reaction between a coupler and an oxidation product of an aromatic primary amine color developing agent and which is connected to the coupler at the nitrogen atom of the coupling off group. Particularly preferred coupling off groups are those represented by the formula (Ia), (Ib), or (Ic):

$$-NHR_1 \quad \text{(Ia)}$$

$$-NR_2R_3 \quad \text{(Ib)}$$

$$-N{=}N-R_4 \quad \text{(Ic)}$$

In the above formulae, $R_1$ represents an acyl group (e.g., a methylsulfonyl group, an ethylsulfonyl group, a benzylsulfonyl group, a phenylsulfonyl group, a perfluoropropylsulfonyl group, an acetyl group, a benzoyl group, a trifluoroacetyl group, a 2,4,6-trifluorobenzoyl group, etc.), a halogenated alkyl group having up to three carbon atoms (e.g., a trifluoromethyl group, a carboxydichloromethyl group, a 1,2,3-trifluoropropyl group, etc.), or a halogenated phenyl group (e.g., a 2-chlorophenyl group, a 2,4-dichlorophenyl group, a 2,3,4,5,6-pentachlorophenyl group, a 2,4,6-trifluorophenyl group, etc.); $R_2$ and $R_3$, which may be the same or different, each represents the same groups as $R_1$ or can be combined together with the nitrogen atom of the coupling off group to form a heterocyclic residue (e.g., a succinimide ring, a phthalmide ring, an oxazolidine ring, an imidazolidine ring, a pyrrolidine ring, a piperidine ring, a pyrroline ring, an imidazoline ring, an oxazoline ring, a morpholine ring, a triazole ring, etc.). In addition to the groups illustrated for $R_1$, examples of $R_2$ and $R_3$ include the above-described rings such as a succinimide ring, a 1-(2,5-dioxoimidazolidinyl) group, a 1-(2,5-dioxo-3-benzylimidazolidinyl) group, a 1-(2,5-dioxooxazolidinyl) group, a phthalimido group, a morpholino group, a 1-(4,4-dimethyl-2,5-dioxoimidazolidinyl) group, 1-(4,4-diethyl2,5-dioxo-oxazolidinyl) group, a 1-pyrrolinyl group, a 1-imidazolyl group, a piperidine-2-(1-1-1)pyridonyl group, a 2-oxopiperidino group, a triazolyl group, etc. $R_4$ represents the same groups as defined for $R_1$, and further represents an unsubstituted or a substituted aryl group with representative examples of substituents being a hydroxyl group, an alkoxy group, a carboxy group, a sulfo group, a halogen atom and the like. Specific examples of substituted aryl groups include a 4-carboxyphenyl group, a 3,6-disulfonaphthyl group, a 2-methoxyphenyl group, a 4-hydroxyphenyl group, a 1-naphthyl group, a 3-methoxyphenyl group, etc. Specific examples of residues represented by the general formulae (Ia) and (Ib) in addition to the above-described residues are described in U.S. Pat. Nos. 3,737,316, 3,458,315, and German Patent Application (OLS) Nos. 2,213,461 and 2,263,875.

Couplers which are particularly preferred in the present invention are represented by the following general formulae (III), (IVa) and (IVb);

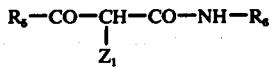

(III)

wherein $Z_1$ represents Z in the general formula (I) or, preferably, is a residue represented by the general formula (Ia) or (Ib); $R_5$ represents a primary, secondary or tertiary alkyl group having 1 to 18 carbon atoms (which may be substituted) (e.g., a hexadecyl group, a tert-butyl group, a 1-methyl group, a propenyl group, a 1,1-dimethyl-1-(p-methoxyphenoxy)methyl group, a 1,1-dimethyl1-ethylthiomethyl group, etc.), an aryl group (e.g., a phenyl group, a 3-octadecylphenyl group, a 2-methoxyphenyl group, a 4-methoxyphenyl group, a 2-chloro-5-[α-(2,4-di-tert-pentylphenoxy)-butyramido]phenyl group, a 2-methoxy-5-tert-butyramidophenyl group, a 2-chloro-5-methanesulfonamidophenyl group, a 3,5-dicarboxyphenyl group, etc.; and $R_6$ represents an aryl group (e.g., a 2-chlorophenyl group, a 2-methoxyphenyl group, a 2-chloro-5-[α-(2,4-ditert-amylphenoxy)methanesulfoamido]phenyl group, a 2-methoxy-5-(2,4-di-t-amylphenoxy)acetamidophenyl group, a 3,5-diethylcarboxyphenyl group, etc.); and a substituent in the 2-position of $R_6$ and the $Z_1$ group may be combined to form a benzomorpholone ring or the like,

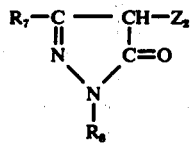

(IVa)

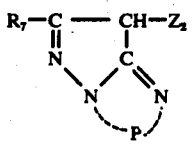

(IVb)

wherein $Z_2$ represents Z in the general formula (I) or, preferably, is a residue represented by the general formula (Ia) or (Ib); P represents the atoms necessary to complete a heterocyclic ring (e.g., a pyrazolobenzimidazole nucleus, etc.); $R_7$ and $R_8$ each represents the same groups as defined for $R_5$ or is an alkoxy group having 1 to 18 carbon atoms (e.g., an ethoxy group, an octadecyloxy group, etc.), a heterocyclic ring (e.g., a quinolinyl group, a piperadinyl group, a pyridyl group, a benzofuranyl group, etc.), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, an α- or β-naphthoxycarbonyl group, etc.), an aralkylthio group (e.g., an ethylthio group, a dodecylthio group, etc.), an arylthio group (e.g., a phenylthio group, an α-naphthylthio group, etc.), a carboxy group, an acylamino group (e.g., an acetamido group, a 3-(2,4-di-tert-amylphenoxy)acetamido benzamido group, etc.), a diacylamino group, an N-alkylacylamino group (e.g, an N-methylpropionamido group, etc.), an N-arylacylamino group (e.g., an N-phenylacetamido group, etc.), a ureido group (e.g., a ureido group, an N-arylureido group, an N-alkylureido group, etc.), a thioureido group (e.g., a thioureido group, an N-arylthioureido group, an N-alkylthioureido group, etc.), an alkoxycarbonylamino group, an aryloxycarbonylamino group, an alkoxythiocarbonylamino group, an aryloxythiocarbonylamino group, an anilino group (e.g., a phenylamino group, an N-alkylanilino group, an N-arylanilino group, an N-acylanilino group, a 2-chloro-5-tetradecanamidoanilino group, etc.), an alkylamino group (e.g., a n-butylamino group, an N,N-dialkylamino group, a cycloalkylamino group, etc.), a cycloamino group (e.g., a piperidino group, a pyrrolidino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an N-alkylcarbamoyl group, an N,N-dialkylcarbamoyl group, an N-alkyl-N-arylcarbamoyl group, an N-arylcarbamoyl group, an N,N-diarylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a guanidino group (e.g., an N-alkylguanidino group, an N-arylguanidino group, etc.), a cyano group, an acyloxy group (e.g., a tetradecyloxy group, etc.), a sulfonyloxy group (e.g, a benzenesulfonyloxy group, etc.), a hydroxy group, a mercapto group, a halogen atom, or a sulfo group.

Couplers of general formula (III) are described in, e.g., U.S. Pat. Nos. 3,227,550; 3,253,924; 3,277,155; 3,265,506; 3,408,194; 3,415,652; French Pat. No. 1,411,384; British Pat. Nos. 944,490; 1,040,710; 1,118,028; German Pat. Nos. (OLS) 2,057,941; 2,163,812; 2,213,461; 2,219,971; 2,263,875; 2,414,006; etc.; the couplers of general formulae (IVa) and (IVb) are described in U.S. Pat. Nos. 3,615,506; 3,701,783; 3,227,554; 3,252,924; 3,311,476; 2,983,608; 2,455,170; 2,725,292; 3,005,712; 3,519,429; 3,419,391 and 3,148,062; and in German (OLS) 2,414,006.

Anilino type couplers are described in U.S. Pat. No. 3,127,269 and in German Patent Nos. (OLS) 2,408,665, 2,357,102, 2,357,122, and 2,446,267.

The couplers used in the present invention are advantageously rendered diffusion-resistant. In order to render the couplers diffusion-resistant, a group containing a hydrophobic residue having 8 to 32 carbon atoms, is introduced into the coupler molecule. Such a residue is called a ballasting group. This ballasting group can be connected to the coupler skeletal structure directly or through a divalent element or group such as nitrogen, oxygen, sulfur and the like.

2-Equivalent couplers to be used in the present invention possess excellent properties. For example, firstly, they have a high coloration reaction activity. Secondly, the necessary number of moles of silver halide for forming one molecule of dye (called equivalency) is small. Thirdly, the conversion of the couplers to colored dyes (coloring efficiency) is remarkably high. Fourthly, the fastness of the dye images comprising the colored dyes is sufficiently high and, in addition, color stain and discoloration of color images due to formaldehydes, acetone, other ketones, sulfur dioxide, or the like are markedly reduced. However, the 2-equivalent couplers to be used in the present invention tend to cause fogging when color development is accelerated by processing at an elevated temperature of particularly 30° C or above, by using a developer containing a color developing agent having a high activity, or by using a development accelerator or a sensitizing agent in order to conduct color development in a short time, e.g., less than about 6 minutes, preferably less than about 3 minutes.

Furthermore, 3-anilino-5-pyrazolone couplers used in the present invention are couplers represented by the general formulae (IVa) and (IVb) wherein $R_7$ represents a group selected from phenylamino groups and $Z_2$ may be a hydrogen atom. In this case, they are 4-equivalent couplers. However, of the magenta couplers, they exhibit a particularly strong coloring ability, exhibit an abnormally high coloring efficiency and, furthermore, the color images obtained are fast with respect to heat, light or humidity and are affected only slightly by sulfur dioxide, formaldehyde or acetone. In addition, the color images are resistant to chemicals brought into the light-sensitive materials by development processing, such as a developing agent, sodium thiosulfate, and an oxidizing agent for bleaching. Therefore, these couplers are advantageous for rapid development. On the other hand, however, these couplers have the defect that they tend to cause fogging similar to 2-equivalent couplers.

As was stated above, for the practical use of these couplers, removal of the defect that these excellent couplers tend to cause fogging upon processing at an elevated temperature, which is also an object of the present invention, is very important.

In contrast to other 2- or 4-equivalent couplers, the couplers of the present invention probably possess the property that, in the step of elimination of the coupling off group in the coupling reaction, fog is caused or fog tends to be caused due to their strong coloration.

The anti-fogging agents in accordance with the present invention are heterocyclic mercapto compounds having a sulfo group, a carboxy group, a hydroxy group, an amino group, preferably a sulfo group or an amino group, i.e., having the general formula (II) described hereinbefore.

The mercapto compounds which are commonly used are described in U.S. Pat. Nos. 1,758,576, 2,304,962, 2,697,040, 2,697,099, 2,824,001, 2,476,536, 2,843,491, 3,251,691, British Pat. Nos. 403,789, 893,428, etc.

The mercapto compounds described in the above-described patents and the like exhibit only an insufficient action in controlling fogging and, when used in an amount sufficient to control fogging, they cause in turn harmful side actions such as a serious reduction in sensitivity and in gradation, a deterioration of the stability of light-sensitive nuclei and of latent images, and the like.

The anti-fogging agent of the present invention exhibits the effect of controlling color fog based on the above-described couplers, (i.e., the compounds having the general formulae (III), (IVa), (IVb) or the 3-anilino-5-pyrazolones) when used in an amount at which the reduction in sensitivity or the deterioration in gradation is small. In particular, when the anti-fogging agent of the present invention is used in combination with a hydroquinone derivative to be described hereinafter, the antifogging agent exhibits a quite excellent anti-fogging effect in a small amount.

The compound to be used in the present invention is particularly the compound represented by the following general formula (V);

$$Q\text{-}SH \qquad (V)$$

wherein Q represents a 5- or 6-membered ring containing at least one N, O, S and Se as a hetero atom, where the -SH moiety is attached to the carbon atom of the ring, or having directly or indirectly bonded thereto at least one substituent selected from a sulfo group, a carboxy group, a hydroxy group and an amino group, such as an oxazole ring, a thiazole ring, an imidazole ring, a selenazole ring, a triazole ring, a tetrazole ring, a thiadiazole ring, an oxadiazole ring, a pyrimidine ring, a thiazine ring, a triazine ring, a thiodiazine ring, etc., or a ring fused with another hydrocarbyl ring (either saturated or unsaturated) or heterocyclic ring, such as a benzothiazole ring, a benzotriazole ring, a benzimidazole ring, a benzoxazole ring, a benzoselenazole ring, a naphthoxazole ring, a triazaindolizine ring, a diazaindolizine ring, a tetrazaindolizine ring, etc.

The above-described effect can further be enhanced further by using, in combination with the mercapto compound of the present invention, a phenolic derivative, preferably a hydroquinone derivative represented by the following general formula (VI);

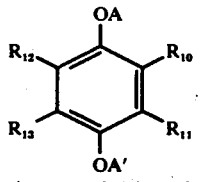

(VI)

wherein A and A' each represents a hydrogen atom or a group capable of being eliminated by an alkali such as an alkoxycarbonyl group, an acyl group, an alkyloxalyl group, etc., each having up to 18 carbon atoms, $R_{10}$, $R_{11}$, $R_{12}$ and $R_{13}$ each represents a hydrogen atom, an alkyl group having 20 or less carbon atoms, for example, methyl, tert-butyl, octyl, t-octyl, dodecyl, octadecyl, 1-methylheptadecyl, etc., an alkenyl group having 20 or less carbon atoms, for example, allyl, etc., an alkylthio group having 20 or less carbon atoms, for example, 2-ethylhexylthio, dodecylthio, octadecylthio, etc., an alkoxy group having 8 or less carbon atoms, for example, methoxy, butoxy, octyloxy, etc., a halogen atoms, for example, chloro, bromo, etc., an aryl group, for example, phenyl, tolyl, etc., a hydroxy group, an arylthio group, for example, phenylthio, etc., a heterocyclic ring thio group (e.g., a tetrazolylthio group, a benzothiazolylthio group, a benzotriazolylthio group, etc.), or a heterocyclic ring (e.g., a benzimidazolyl group, a triazolyl group, an oxazolyl group, etc.), provided that at least one of $R_{10}$ to $R_{13}$ is an alkyl, alkenyl or alkylthio group having 8 to 20 carbon atoms and that the number of alkyl, alkenyl or alkylthio groups does not exceed 2.

These compounds are described in, e.g., U.S. Pat. Nos. 2,336,327, 2,728,659, 2,835,579, Japanese Patent Application (OPI) No. 2128/71, etc.

Preferred examples of the couplers and mercapto compounds which can be used in the present invention are illustrated below but the present invention is not to be construed as being limited to these examples.

(Y-1)

α-(4-Methoxycarbonylphenoxy)-α- 3-[α-(2,4-di-tert-amylphenoxy)butyramido]benzoyl -2-methoxyacetanilide, (Y-2)

α-(2,4-Dioxo-5,5'-dimethyloxazolidinyl)-α-pivaloyl-2-chloro-5-[α-(2,4-di-tert-amylphenoxy)-butyramido]acetanilide, (Y-3)

α-(4-Carboxyphenoxy)-α-pivaloyl-2-chloro-5-[α-(2,4-di-tert-amylphenoxy)butyramido]acetanilide, (Y-4)

α-[3-(1-Benzyl-2,4-dioxo)imidazolidinyl)-α-pivaloyl-2-chloro-5-[α-(2,4-di-tert-amylphenoxy)-butyramido]acetanilide, (Y-5)

α-(4-Methoxybenzoyl)-α-(3,5-dioxomorpholino)-5-[γ-(2,4-di-tert-amylphenoxy)butyramido]-2-chloroacetanilide, (Y-6)

α-[3-(1-Benzyl-2,4-dioxo-5-methoxy)imidazolidinyl]-αpivaloyl-2-chloro-5-[α-(2,4-di-tert-amylphenoxy)butyramido]acetanilide, (Y-7)

α-[3-(1-Methyl-5-benzyl-2,4-dioxo-1,3,5-triazolidinyl)]α-pivaloyl-2-chloro-5-[α-(2,4-di-tert-amylphenoxy)butyramido]-acetanilide, (Y-8)

α-3-(5-Methyl-2,4-dioxothiazolidinyl)-α-pivaloyl-2-chloro-5-[α-(2,4-di-tert-amylphenoxy)-butyramido]acetanilide, (M-1)

1-(2,4,6-Trichlorophenyl)-3- 3-[α-(2,4-di-tert-amylphenoxy)acetamido]benzamido -4-(α-fluoropropionamido)-5-pyrazolone, (M-2)

1-(2,4,6-Trichlorophenyl)-3-tridecylamido-4-(4-hydroxyphenylazo)-5-pyrazolone, (M-3)

1-(2,6-dichloro-4-methoxyphenyl)-3-[(2-chloro-5-tridecanoylamido)anilino]-4-benzenesulfoamido-5-pyrazolone, (M-4)

1-(2,4,6-Trichlorophenyl)-3-(2-chloro-5-tetradecyloxycarbonyl)anilino-4-(1-naphthylazo)-5-pyrazolone, (M-5)

1-(2,4,6-Trichlorophenyl)-3- 3-[(2,4-di-tert-amylphenoxy)acetamido]benzamido -4-piperidino-5-pyrazolone, (M-6)

1-(2,4,6-Trichlorophenyl)-3-(2-methoxy-5-tridecanamidoanilino)-4-N-phthalimido-5-pyrazolone, (M-7)

1-(2,4,6-Trichlorophenyl)-3- 3-[α-(3-tert-butyl-4-hydroxyphenoxy)dodecanoylamido]anilino -5-pyrazolone, (M-8)

1-(2,4-Dimethyl-6-chlorophenyl)-3-[(2-chloro-5-tetradecanoylamido)anilino]-5-pyrazolone, (M-9)

1-(2,6-Dichloro-4-tetradecyloxycarbonylphenyl)-3-(2-chloro-5-methoxycarbonylanilino)-4-succinimido-5-pyrazolone, (M-10)

1-(2,4,6-Trichlorophenyl)-3-(2,4-dichloroanilino)-4-(4-tetradecanamidophenylsulfonamido)-5-pyrazolone, (M-11)

1- [4-(2,4,-Di-tert-amylphenoxy)acetamido]phenyl -3-(3-acetamidobenzamido)-4-(N,N-diethylamino)-5-oxo-2-pyrazoline, (M-12)

1-(2,4,6-Trichlorophenyl)-3- 2-chloro-5-[β-(dodecyloxycarbonyl)ethylcarbonyl]anilino -4-(pentafluorophenylureido)-5-pyrazolone, (M-13)

1-(2,4,6-Trichlorophenyl)-3-(2-chloro-5-tetradecylcarbamoylanilino)-4-diethylphosphoric acid amido)-5-pyrazolone, (M-14)

N-[1-(2,6-Dichloro-5-methoxyphenyl)-3- 3-[(2,4-di-tertamylphenoxy)acetamido]benzamido -5-pyrazolon-4-yl]phenyl carbamate, (M-15)

1-(2,6-Dichloro-4-methoxyphenyl)-3- 3-[α-(2,4-di-tertamylphenoxy)butyramido]benzamido -4-piperidino-5-pyrazolone, (M-16)

1-(4-Acetamidophenyl)-3-(2-methoxy-5-tetradecyloxycarbonylanilino)-4-(5,5-dimethyl-2,4-dioxo-3-imidazolinyl)-5-pyrazolone, (M-17)

1- 4-[α-(2,4-Di-tert-amylphenoxy)butyramido]phenyl -3-methyl-4-(5,5-diethyl-2,4-dioxo-3-oxazolidinyl)-5-pyrazolone, (M-18)

1-(2,4-Dimethyl-6-dichlorphenyl)-3-[(3-tetradecanamido)-benzamido]-4-(2-oxo-piperidino)-5-pyrazolone, (M-19)

1-(2,4,6-Trichlorophenyl)-3-heptadecyl-4-(1-pyrrolinyl)-5-pyrazolone, (M-20)

1-(2,4,6-Trichlorophenyl)-3- 3-[α-(3-n-pentadecylphenoxy)-butyramido]benzamido -4-(1-imidazolyl)-5-pyrazolone, (M-21)

1-(2,4,6-Trichlorophenyl)-3--
-[2-hydroxy-3-(5-n-butyl-2-benzotriazolyl)-5-n-pentyl]butyramido -4-phenylsulfonamido-5-oxo-2-pyrazoline, (M-22)

1-(2,4,6-Trichlorophenyl)-3- 3-[α-(2,4-di-tert-amylphenoxy)-butyamido]benzamido -4-phenylsulfonamido-5-pyrazolone, (M-23)

1-(2,4,6-Trichlorophenyl)-3- 3-[α-(3-tert-butyl-4-hydroxyphenoxy)tetradecanamido]benzamido -4-methylsulfonamido-5-pyrazolone, (M-24)

1-(2,4-Dimethyl-6-chlorophenyl)-3- 3-[α-(2,4-di-tertamylphenoxy)butyramido]phenylureido -4-(1-benzimidazolyl)-5-pyrazolone, (F-1)

2-Mercapto-5-sulfo-benzimidazole, (F-2)

2-Mercapto-5-carboxy-benzothiazole, (F-3)

2-Mercapto-5-carboxy-benzoselenazole,

(F-4)

2-Mercapto-7-carboxy-benzoxazole, (F-5)

2-Mercapto-1-sulfopropyl-5-chlorobenzimidazole, (F-60

1-Sulfophenyl-5-mercapto-tetrazole, (F-7)

2-Mercapto-5-sulfobutylthio-thiodiazole, (F-8)

2-Mercapto-5-carboxy-benzimidazole, (F-9)

2-Mercapto-5-sulfo-benzothiazole, (F-10)

2-Mercapto-5-carboxy-benzoxazole, (F-11)

2-Mercapto-1-hydroxyethyl-benzimidazole, (F-12)

2-Mercapto-4-carboxyethyl-imidazole, (F-13)

4-Sulfophenyl-3-mercapto-1,2,4-triazole, (F-14)

2-Mercapto-5-sulfo-6,7-benzoxazole, (F-15)

2-Mercapto-7-sulfo-5,6-benzoxazole, (F-16)

2-Mercapto-5-amino-1,3,4-thiadiazole, (F-17)

2-Mercapto-5-hydroxyethyl-13,4-thiadiazole.

These mercapto compounds can be synthesized according to the process described in Japanese Patent Publication No. 28496/65 and Japanese Patent Application No. 139234/73 (which corresponds to U.S. Ser. No. 531,122 filed Dec. 9, 1974).

Additionally, the following compounds are illustrated as preferred examples of hydroquinone derivatives capable of enhancing the effect when used in combinations with the above-described mercapto compounds. However, the present invention is not to be construed as being limited to these compounds, (A)

2,5-Di-tert-octylhydroquinone, (B)

2-n-Hexadecyl-hydroquinone, (C)

2-n-Octadecylthio-hydroquinone, (D)

2-n-Octadecylthio-5-tert-octyl-hydroquinone.

The couplers of the present invention can be roughly classified into Fischer type couplers having a water-solublizing group such as a carboxy group, a hydroxy group, a sulfo group, etc., and hydrophobic couplers. Conventionally known methods for adding couplers to or dispersing coupers in a gelatino-silver halide emulsion or a hydrophilic colloid can be employed. For example, the method comprising mixing a coupler with a high-boiling organic solvent such as dibutyl phthalate, tricresyl phosphate, a wax, a higher fatty acid or an ester thereof, a fatty oil, particularly a glycerol lower fatty acid ester, an aliphatic ester of citric acid, etc., and dispersing, the method described in, e.g., U.S. Pat. Nos. 2,304,939, 2,322,027, Japanese Patent Application No. 75126/73, etc., the method comprising mixing a low-boiling organic solvent or a water-soluble organic solvent with a coupler and dispersing, the method comprising additionally using in combination a high boiling organic solvent for dispersing a coupler, the method described in, e.g., U.S. Pat. Nos. 2,801,170, 2,801,171, 2,949,360, etc., the method comprising dispersing a coupler having a low melting point (for example, about 75° C or less) individually or in combination with other couplers to be used together, such as a colored coupler or an uncolored coupler, the method described in, e.g., German Pat. No. 1,143,707, etc., can be employed. The method comprising dispersing a coupler in a synthetic polymer (e.g., butyl acrylate-hydroxyethyl methacrylate copolymer, etc.) with the help of an organic auxiliary solvent can also be employed.

Usually from about $10^{-6}$ to $10^{-3}$ mol/m² of the couplers of general formulae (III) and (IV) can be added to one emulsion layer (range applies to individual amounts of each coupler).

The mercapto compound of the present invention can be added to an emulsion by dissolving the mercapto compound in water, methanol, methyl Cellosolve, acetone or as an aqueous solution solubilized with an anionic surface active agent. The amount of the mercapto compound to be added preferably ranges from about $10^{-5}$ to $5 \times 10^{-2}$ mole per mole of silver halide.

The hydroquinone derivative to be used in the present invention can be dispersed separately or in combination with a coupler in the same manner as the couplers, and then added to an emulsion. Usually from 0 to about 2 times (by weight) the amount of coupler(s) of the hydroquinone derivative can be added to the emulsion.

Commonly used anionic surface active agents (e.g., sodium alkylbenzenesulfonates, sodium dioctylsulfosuccinate, sodium dodecylsulfate, sodium alkylnaphthalenesulfonates, Fischer type couplers, etc.), amphoteric surface active agents (e.g., N-tetradecyl-N,N-dipolyethylene-α-betaine, etc.), and nonionic surface active agents (e.g., sorbitan monolaurate, etc.) can be used as the dispersing aid.

The emulsion to be used in the present invention is a silver halide photographic emulsion, preferably a gelatino emulsion containing silver chloride, silver bromide, silver iodide or mixed silver halide grains. The silver halide grains can possess a crystal habit of a (100) face, a (111) face or a mixture thereof, and can be regular grains or grains having a twin plane. The grain size can range from about 0.04 μ to 2 μ.

Emulsions obtained according to any of a single jet process, a double jet process, a control double jet process, a triple jet process, a reverse-mixing process and a conversion process can be used as the emulsion to be used in the present invention.

For example, the silver halide emulsion used is this invention can be prepared by mixing an aqueous solution of a water-soluble silver salt such as silver nitrate and an aqueous solution of a water-soluble halide such as potassium bromide in the presence of a water-soluble polymer such as gelatin.

Also, two or more silver halide emulsions prepared separately can be mixed to produce a silver halide emulsion. Furthermore, the silver halide grains used in this invention can have a uniform crystal structure throughout the entire grain or have a layer structure wherein the interior has a different structure than that of the outer portion of the grain. The silver halide grains can be the so-called conversion type silver halide grains as described in British Pat. No. 635,841 and U.S. Pat. No. 3,622,318, if desired. Moreover, the silver halide grains can be the type wherein a latent image is mainly forward on the surfaces of the grains or the type wherein a latent image is mainly formed in the interior of the grains. These silver halide photographic emulsions can be prepared by various methods, such as an ammonia method, a neutralization method, an acid method, etc.

The hydrophilic colloids which can be used as the vehicle for the silver halide in this invention include gelatin, colloidal albumin, casein, cellulose derivatives such as carboxymethyl cellulose, hydroxyethyl cellulose, agar agar, alginates such as sodium alginate, starch derivatives, synthetic hydrophilic polymer colloids, e.g., polyvinyl alcohol, poly-N-vinyl pyrrolidone, polyacrylic acid copolymers, polystyrene-sulfonic acid, polyacrylamide and the derivatives and the partially hydrolyzed products thereof. If desired, a mixture of two or more these colloids which are compatible with each other can be used. Of the above-described colloids, gelatin is most generally used but a part or all of the gelatin can be replaced with a synthetic polymer. Furthermore, a so-called gelatin derivative, that is to say, gelatin modified by treating the gelatin with a compound having a group capable of reacting with the functional groups of the gelatin molecule, i.e., an amino group, an imino group, a hydroxyl group, and a carboxyl group or also a graft polymer of gelatin formed by bonding the molecular chain of another polymer to the gelatin can be substituted for a part or all of the gelatin.

Also, synthetic polymer compounds such as latex-like vinyl compound polymers dispersed in water, compounds capable of increasing, in particular, the dimensional stability of photographic materials, and the like, individually or as a combination (of different polymers) or in combination with a hydrophilic, water-permeable colloid can be incorporated in the photographic emulsion layers and other layers. Examples of these polymers include many compounds as described in, e.g., U.S. Pat. Nos. 2,736,005, 2,739,137, 2,853,457, 3,062,674, 3,411,911, 3,488,708, 3,525,620, 3,635,715, 3,607,290, 3,645,740, British Pat. Nos. 1,186,699, 1,307,373, etc. Of these compounds, copolymers or homopolymers of monomers selected from alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkosyalkyl acrylates, alkoxyalkyl methacrylates, styrene, butadiene, vinyl chloride, vinylidene chloride, maleic anhydride and itaconic anhydride are generally used. In some cases, a so-called graft-type emulsion polymerization latex prepared by conducting emulsion polymerization in the copresence of a hydrophilic protective colloid high molecular weight polymer can be used.

The silver halide emulsion used in this invention can be chemically sensitized. Examples of the chemical sensitizers which can be used for the purpose are, for instance, gold compounds such as auric acid chloride, gold trichloride, etc., as described in U.S. Pat. Nos. 2,399,083; 2,540,085; 2,597,856; and 2,597,915, salts of noble metals such as platinum, palladium, iridium, rhodium, ruthenium, etc., as described in U.S. Pat. Nos. 2,448,060; 2,540,086; 2,566,245; 2,566,263; 2,598,079, etc., sulfur compounds capable of forming silver sulfite by reaction with silver salts as described in U.S. Pat. Nos. 1,544,944; 2,410,689; 3,189,458; and 3,501,313, sulfur sensitization as described in U.S. Pat. Nos. 1,623,499 and 2,410,689, and stannous salts, amines and other reductive materials as described in U.S. Pat. Nos. 2,487,850; 2,518,698; 2,421,925; 2,521,026; 2,694,637; 2,983,610 and 3,201,254.

The silver halide photographic emulsion used in this invention can be subjected to a spectral sensitization or dye sensitization using cyanine dyes such as cyanine, merocyanine, carbocyanine dyes individually or as a combination thereof. These dye sensitization techniques are well known as disclosed in U.S. Pat. Nos. 2,688,545; 2,912,329; 3,397,060; 3,615,635; 3,628,964; British Pat. Nos. 1,195,302; 1,242,588; and 1,293,862, German Patent Application (OLS) Nos. 2.030,326 and 2,121,780, and Japanese Patent Publication Nos. 4936/1968 and 14030/1969. They can be selected appropriately according to the wave length region to be senitized, the sensitivity desired and the purposes and uses of the color photographic materials.

In addition, commonly used stabilizers (e.g., 4-hydroxy-1,3,3a,7-tetrazaindene derivatives, etc.), antifogging agents (e.g., other mercapto compounds or benzotriazole compounds commonly known), a coating aid, a hardener, a wetting agent, and a sensitizer (e.g., an onium derivative such as quaternary ammonium salt described in U.S. Pat. Nos. 2,271,623, 2,288,226, and 2,334,864, a polyalkylene oxide derivative described in U.S. Pat. Nos. 2,708,162, 2,531,832, 2,533,990, 3,210,191 and 3,158,484) can be incorporated. Also, dyes for preventing irradiation or a filter layer, a mordant dyeing layer and a hydrophobic dye-containing colored layer can be incorporated as a constituent of the stratum of color light-sensitive materials in accordance with the present invention.

The silver halide emulsion further can be hardened using conventional methods. Hardening agents which can be used include aldehyde compounds such as formaldehyde, glutaraldehyde, etc.; ketone compounds such as diacetyl and cyclopentadione; bis(2-chloroethylurea); 2-hydroxy-4,6-dichloro-1,3,5-triazine; compounds having reactive halogens as described in U.S. Pat. Nos. 3,288,775 and 2,732,303 and British Pat. Nos. 974,723 and 1,167,207; divinyl sulfone, 3-acetyl-1,3-1,3,5-triazine; and also the various compounds described in U.S. Pat. Nos. 3,635,718 and 3,232,763; British Pat. No. 994,869; and U.S. Pat. Nos. 2,732,316; 2,586,168; 3,103,437; 3,017,280; 2,983,611; 2,725,294; 2,725,295; 3,100,704; 3,091,537; 3,321,313; and 3,543,292.

The above-described silver halide emulsions can further contain surface active agents, either individually or a mixture thereof. These surface active agents can be used as coating aids, dispersing agents, and senitizers as well as for improving the photographic characteristics, static prevention, and adhesion prevention. These surface active agents include natural surface active agents such as saponin, etc.; nonionic surface active agents such as alkylene oxides, glycerins, glycidols, etc.; anionic surface active agents such as higher alkylamines, quaternary ammonium salts, pyridine, other heterocyclic compounds, phosphoniums, and sulfoniums; and amphoteric surface active agents such as aminoacids, aminosulfonates, sulfuric acid esters or phosphoric acid esters of aminoalcohols, etc.

Some specific examples of surface active agents which can be used in this invention are illustrated in U.S. Pat. Nos. 2,271,623; 2,240,472; 2,288,226; 2,739,891; 3.068,101; 3,158,484; 3,201,253; 3,210,191; 3,294,540; 3,415,649; 3,441,413; 3,442,654; 3,475,174; and 3,545,974, German Patent Application (OLS) No. 1,942,665, and British Pat. Nos. 1,077,317 and 1,198,450.

The light-sensitive emulsion to be used in the present invention can be coated on various supports. For example, suitable supports include a cellulose acetate film, a polyethylene terephthalate film, a polyethylene film, a polypropylene film, a glass plate, a baryta paper, a resin-laminated paper, a synthetic paper, etc. Usually from about $5 \times 10^{-5}$ to $10^{-1}$ mol/m$^2$ of silver halide is utilized.

In order to obtain dye images from the color photographic light-sensitive material of the present invention, development processing is conducted after imagewise exposure. Development processing fundamentally involves a color development step, a bleaching step and a fixing step. In this case, each step can be conducted separately or two or more steps can be combined using a processing solution capable of conducting both functions in one step. A bleach-fixing solution is one example of such a combined function. Also, each step can be conducted, if desired, by separation into two or more steps, or a combination such as color development, first fixing and bleach-fixing is also possible. Additionally, if desired, a pre-hardening bath, a neutralizing bath, a first development (black-and-white development), an imagestabilizing bath, a washing with water, and the like can be employed in the development-processing step. The processing temperature is selected depending on the light-sensitive materials to be processed and processing formulations employed. Temperatures ranging from about 20° C to 60° C are often used. The light-sensitive material in accordance with the present invention is particularly adapted to be processed at a temperature of about 30° C or above. Additionally, the temperature of each of the processing steps need not necessarily be the same.

The color developer is an aqueous solution having a pH of about 8 or above, particularly 9 to 12, and contains a compound, i.e., a developing agent, whose oxidation product can react with a color forming agent, called a coupler, to form a colored product. The above-described developing agent is a compound having a primary amino group on an aromatic ring and has the ability of developing exposed silver halide, or is a precursor thereof capable of forming such compound. For example, preferred typical examples include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino-3-methoxy-N,N-diethylaniline, 4-amino-3-methyl-N-β-methoxyethylaniline, 4-amino-3-methoxy-N-ethyl-N-β-methoxyethylaniline, 4-amino-3-β-methanesulfoamidoethyl-N,N-diethylaniline, and the salts thereof (e.g., the sulfates, hydrochlorides, sulfites, p-toluenesulfonates, etc.). In addition, examples of suitable developing agents are described in U.S. Patents 2,193,015, 2,592,364, Japanese Patent Application (OPI) No. 64933/73, L. F. A. Mason; *Photographic Processing Chemistry*, pp. 226–229, Focal Press, London, (1966), etc.

Also, these color developing agents can be used in combination with 3-pyrazolidones.

Various additives can be added, if desired, to the color developing solution. Typical examples of suitable additives include an alkali agent (e.g., a hydroxide, carbonate or phosphate of an alkali metal or ammonia), a pH-adjusting or buffering agent (e.g., a weak acid such as acetic acid, boric acid, etc., a weak base, and the salt thereof), a development accelerator (e.g., various pyridinium compounds described in U.S. Pat. Nos. 2,648,604, 3,671,247, etc., cationic compounds, potassium nitrate, sodium nitrate, a polyethylene glycol condensate as described in U.S. Pat. Nos. 2,533,990, 2,577,127, 2,950,970, etc., and the derivatives thereof, nonionic compounds such as polythioethers represented by the compounds described in British Pat. No. 1,020,033 and 1,020,032, polymers containing sulfite ester groups represented by the compounds described in U.S. Pat. No. 3,068,097, organic amines such as pyridine, ethanolamine, etc., benzyl alcohol, hydrazines, and the like, an anti-fogging agent (e.g., potassium bromide, an alkali metal iodide, nitrobenzimidazoles as described in U.S. Pat Nos. 2,496,940 and 2,656,271, mercaptobenzimidazole, 5-methylbenzotriazole, 1-phenyl-5-mercaptotetrazole), compounds for rapid processing solutions as described in U.S. Pat. Nos. 3,113,864, 3,342,596, 3,295,976, 3,615,522, 3,597,199, etc., thiosulfonyl compounds as described in British Pat. No. 972,211, phenazine N-oxides as described in Japanese Patent Publication No. 41675/71, antifigging agents as described in *Kagaku Shashin Binran* (*Handbook of Photographic Science*), II, pp. 29–47, etc.), stain- or sludge-preventing agents as described in U.S. Pat. Nos. 3,161,513, 3,161,514, British Pat. Nos. 1,030,442, 1,144,481, 1,251,558, an an interimage effect-accelerating agent as described in U.S. Pat. Nos. 3,536,487, etc., and a preservative (e.g., a sulfite, a bisulfite, hydroxylamine hydrochloride, an alkanolamine-sulfite adduct, a formaldehyde-bisulfite adduct, etc.).

The present invention will now be illustrated in more detail by the following non-limiting examples of preferred embodiments of the present invention. Unless otherwise indicated herein, all parts percents, ratios and the like are by weight.

EXAMPLE 1

50 ml of di-n-butyl phthalate and 100 ml of ethyl acetate were added to 52.4 g. of Coupler (Y-2), α-(2,4-dioxo-5,5-dimethyloxazolidinyl)-α-pivaloyl-2-chloro-5-[α-(2,4-di-t-amylphenoxy)-butyramido] acetanilide, and heated to 60° C. The thus obtained solution was added to 500 ml of an aqueous solution containing 50 g of gelatin and 2.5 g of sodium dodecylbenzenesulfonate and stirred, follwed by vigorous mechanical stirring for 30 minutes using a high speed agitator. As a result, the coupler was finely emulsified and dispersed together with the solvent.

The total amount of the resulting fine emulsion dispersion was added to 1 Kg of a photographic emulsion containing 56.5 g of silver bromoiodide (containing 2 mole % iodide) and 60 g of geltain to prepare Emulsion (A).

In a manner absolutely the same as described above except for using 57.0 g of Coupler (Y-4), α-[3-(1-benzyl-2,4-dioxo)-hydantoin]-α-pivaloyl-2-chloro-5-[α-(2,4-di-t-amylphenoxy)butyramido]-acetanilide, in place of Coupler (Y-2), Emulsion (B) was prepared.

170 g of each of Emulsions (A) and (B) was weighed out and, after adjusting the temperature to 35+ C to dissolve, a $1.0 \times 10^{-3}$ mole aqueous solution of Compound (F1) was added thereto in an amount of 0 ml, 0.3 ml, 1.0 ml, 3.0 ml, 10.0 ml or 30.0 ml. Then, after leaving the mixture to stand for 30 minutes at 35° C, 10 ml of a 2% aqueous solution of 1-hydroxy-3,5-dichloro-s-triazine sodium salt was added thereto as a hardening agent. Finally, the solution was adjusted to a pH of 6.5 and the solution was coated on a cellulose triacetate film support in a coated silver amount of 10.0 mg/100 $cm^2$, and a solution prepared by adding 45 ml of a 2% aqueous solution of 1-hydroxy-3,5-dichloro-s-triazine sodium salt as a hardener to 1,000 ml of an aqueous solution containing 30 g of gelatin was coated thereon as a protective layer in a dry thickness of 1.0 μ to prepare color photographic light-sensitive materials.

These photographic light-sensitive materials were subjected to stepwise exposure for sensitometry, and to the following processings in order.

| Processing Step | Temperature (° C) | Time (sec.) |
|---|---|---|
| 1. Color Development | 32 | 240 |
| 2. Washing | " | 5 |
| 3. First Fixing | " | 30 |
| 4. Washing | " | 120 |
| 5. Bleaching | " | 60 |
| 6. Washing | 32 | 60 |
| 7. Second Fixing | " | 90 |
| 8. Washing | " | 90 |
| 9. Drying | — | — |

The processing solutions used possessed the following compositions.

| Color Developer | |
|---|---|
| Sodium Sulfite | 2 g |

-continued

| Color Developer | |
|---|---|
| 4-Amino-3-methyl-N,N-diethyl-aniline Hydrochloride | 2 g |
| Sodium Carbonate (monohydrate) | 60 g |
| Potassium Bromide | 1 g |
| Hydroxylamine Hydrochloride | 0.6 g |
| Water to make the total | 1000 ml |
| First Fixing Solution | |
| Sodium Thiosulfate | 150 g |
| Sodium Sulfite | 15 g |
| Glacial Acetic Acid (28% aqueous solution) | 48 ml |
| Boric Acid | 7.5 g |
| Water to make the total | 1000 ml |
| Bleaching Solution | |
| Potassium Bromide | 20 g |
| Potassium Ferricyanide | 100 g |
| Glacial Acetic Acid | 20 ml |
| Sodium Acetate | 40 g |
| Water to make the total | 1000 ml |
| Second Fixing Solution | |
| Sodium Thiosulfate | 200 g |
| Sodium Acetate | 70 g |
| Sodium Sulfite | 15 g |
| Water to make the total | 1000 ml |

After processing, the optical density of these sample films to blue light was measured to obtain the photographic properties as tabulated in Table 1.

Table 1

| Emulsion | Mercapto Compound: Compound | Mercapto Compound: Amount Added (ml) | Fog | Gamma | Maximum Density | Sensitivity* (Δ log E) |
|---|---|---|---|---|---|---|
| | | — | 0.57 | 2.45 | 3.12 | 0.00 |
| | | 0.3 | 0.28 | 2.63 | 3.10 | 0.03 |
| (A) | (F1) | 1.0 | 0.16 | 2.71 | 3.15 | 0.05 |
| | | 3.0 | 0.09 | 2.77 | 3.14 | 0.09 |
| | | 10.0 | 0.08 | 2.68 | 3.09 | 0.15 |
| | | 30.0 | 0.08 | 2.42 | 3.07 | 0.25 |
| | | — | 0.52 | 2.26 | 3.06 | 0.00 |
| | | 0.3 | 0.27 | 2.40 | 3.05 | 0.03 |
| (B) | (F1) | 1.0 | 0.17 | 2.45 | 3.09 | 0.06 |
| | | 3.0 | 0.10 | 2.48 | 3.05 | 0.10 |
| | | 10.0 | 0.09 | 2.47 | 3.03 | 0.17 |
| | | 30.0 | 0.08 | 2.31 | 3.00 | 0.29 |

*Relative value of the difference of the exposure amount (logE) necessary for obtaining a density of fog + 0.10 based on that of a mercapto compound-free sample.

Further, as a result of incubation testing at 40° C, 80% RH for 2 days, the properties as shown in Table 2 were obtained.

Table 2

Photographic Properties Before and After Incubation

| Emulsion | Mercapto Compound: Compound | Mercapto Compound: Amount Added | Fog | | Gamma | | Maximum Density | | Sensitivity (Δlog E) | |
|---|---|---|---|---|---|---|---|---|---|---|
| | | (ml) | Before | After | Before | After | Before | After | Before | After |
| | | — | 0.57 | 0.65 | 2.45 | 2.29 | 3.12 | 3.10 | 0.00 | 0.05 |
| | | 0.3 | 0.28 | 0.29 | 2.63 | 2.56 | 3.10 | 3.11 | 0.03 | 0.07 |
| (A) | (F1) | 1.0 | 0.16 | 0.16 | 2.71 | 2.58 | 3.15 | 3.12 | 0.05 | 0.08 |
| | | 3.0 | 0.09 | 0.09 | 2.77 | 2.62 | 3.15 | 3.14 | 0.09 | 0.12 |
| | | 10.0 | 0.08 | 0.08 | 2.68 | 2.53 | 3.09 | 3.06 | 0.15 | 0.17 |
| | | 30.0 | 0.08 | 0.08 | 2.42 | 2.26 | 3.07 | 3.03 | 0.25 | 0.28 |
| | | — | 0.52 | 0.62 | 2.26 | 2.04 | 3.06 | 3.02 | 0.00 | 0.05 |
| | | 0.3 | 0.27 | 0.29 | 2.40 | 2.23 | 3.05 | 3.05 | 0.03 | 0.08 |
| (B) | (F1) | 1.0 | 0.17 | 0.18 | 2.45 | 2.27 | 3.09 | 3.07 | 0.06 | 0.10 |
| | | 3.0 | 0.10 | 0.10 | 2.48 | 2.26 | 3.05 | 3.04 | 0.01 | 0.15 |
| | | 10.0 | 0.09 | 0.09 | 2.47 | 2.19 | 3.03 | 3.00 | 0.17 | 0.20 |
| | | 30.0 | 0.08 | 0.08 | 2.31 | 2.07 | 3.00 | 2.94 | 0.29 | 0.32 |

The sensitivity of a mercapto compound-free sample before incubation was taken as a standard. The indication of the sensitivity is in the same manner as in Table 1.

From the above-described results, it is clear that the combined use of the 2-equivalent yellow coupler to be used in the present invention with a sulfonic acid group-containing mercapto compound provides the effect of sufficiently controlling fogging with less reduction in gamma and less reduction in sensitivity in color development at an elevated temperature. In addition, it can be seen that, even after incubation testing under high temperature and high humidity, sufficient effects are demonstrated and excellent properties are obtained.

EXAMPLE 2

110 ml of di-n-butyl phosphate and 200 ml of ethyl acetate were added to 110 g of Coupler (Y-5), (4-methoxybenzoyl)-α-(3,5-dioxomorpholino)-2-chloro-5-[γ-(2,4-di-t-amylphenoxy)-butyramido]acetanilide, and heated to 60° C to dissolve. The resulting solution was added to 1000 ml of an aqueous solution containing 100 g of gelatin and 5.5 g of sodium dodecylbenzenesulfonate, passed 5 times through a previously heated colloid mill to finely emulsify and disperse the coupler together with the solvent.

The total amount of the resulting emulsion dispersion was added to 2 Kg of a photographic emulsion containing 5 mole % of iodide, 113.5 g of silver bromoiodide and 125 g of gelatin to prepare Emulsion (C).

170 g portions of this Emulsion (C) were weighed out and, after heating the emulsion to dissolve, the temperature thereof was adjusted to 35° C. Then, each of 1.0 × $10^{-3}$ mole aqueous solutions of Compounds (F2), (F4) and (F8) were added, respectively, in an amount of 1 ml, 5 ml or 25 ml.

For comparison, each of $1.0 \times 10^{-3}$ mole methanol solutions of 2-mercaptobenzotriazole (Compound 2A), 2-mercaptobenzoxazole (Compound 4A) and 2-mercaptobenzimidazole (Compound 8A) was added in a corresponding amount.

After the addition, these emulsions were allowed to stand for 30 minutes at 35° C and a hardener was added thereto in absolutely the same manner as described in Example 1. Then, the pH of the emulsions was adjusted, followed by coating the emulsions on a cellulose triacetate film support in a coated silver amount of 10.0 mg/100 cm². Then, a protective layer was coated thereon in the same manner as in Example 1 to prepare color photographic light-sensitive materials.

These photographic light-sensitive materials were subjected to stepwise exposure for sensitometry, and to the following processings in order.

| | Processing Step | Temperature(° C) | Time (min) |
|---|---|---|---|
| 1. | Color Development | 38 | 3 |
| 2. | Stopping | " | 1 |
| 3 | Washing | " | 1 |
| 4. | Bleaching | " | 2 |
| 5. | Washing | 38 | 1 |
| 6. | Fixing | " | 2 |
| 7. | Washing | " | 2 |
| 8. | Drying | — | — |

The processing solutions used possessed the following compositions.

| | |
|---|---|
| 10 Color Developer | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Disodium Ethylenediamine-tetraacetate | 2 g |
| 4-Amino-3-methyl-N-ethyl-N-(β-hydroxyethyl)aniline Monosulfate | 4 g |
| Water to make the total | 1000 ml |
| Stopping Solution | |
| Sodium Thiosulfate | 10 g |
| Ammonium Thiosulfate (70% aq. soln.) | 30 ml |
| Acetic Acid | 30 ml |
| Sodium Acetate | 5 g |
| Potassium Alum | 15 g |
| Water to make the total | 1000 ml |
| Bleaching Solution | |
| Fe(III)-Ethylenediaminetetraacetic Acid (2Na) complex Salt | 100 g |
| Potassium Bromide | 50 g |
| Ammonium Nitrate | 50 g |
| Boric Acid | 5 g |
| Aqueous Ammonia | in an amount necessary for adjusting the pH to 5.0 |
| Water to make the total | 1000 ml |
| Fixing Solution | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make the total | 1000 ml |

After processing, the optical density of these films to blue light was measured to obtain the photographic properties as shown in Table 3.

Table 3

| Mercapto Compound | | | | | |
|---|---|---|---|---|---|
| Compound | Amount Added (ml) | Fog | Gamma | Maximum Density | Sensitivity* (Δ log E) |
| — | — | 0.45 | 2.18 | 3.31 | 0.00 |
| | 1 | 0.19 | 2.30 | 3.34 | 0.06 |
| (F2) | 5 | 0.10 | 2.28 | 3.31 | 0.12 |
| | 25 | 0.08 | 2.14 | 3.29 | 0.23 |
| | 1 | 0.20 | 2.19 | 3.30 | 0.10 |
| (2A) | 5 | 0.12 | 2.04 | 3.26 | 0.22 |
| | 25 | 0.08 | 1.79 | 3.19 | 0.45 |
| | 1 | 0.25 | 2.27 | 3.31 | 0.04 |
| (F4) | 5 | 0.18 | 2.29 | 3.30 | 0.11 |
| | 25 | 0.10 | 2.22 | 3.33 | 0.20 |
| | 1 | 0.24 | 2.17 | 3.29 | 0.12 |
| (4A) | 5 | 0.16 | 1.98 | 3.23 | 0.27 |
| | 25 | 0.10 | 1.64 | 3.11 | 0.58 |
| | 1 | 0.18 | 2.32 | 3.32 | 0.06 |
| (F8) | 5 | 0.09 | 2.25 | 3.29 | 0.11 |
| | 25 | 0.07 | 2.08 | 3.26 | 0.21 |
| | 1 | 0.21 | 2.20 | 3.27 | 0.15 |
| (8A) | 5 | 0.12 | 1.86 | 3.14 | 0.35 |
| | 25 | 0.09 | 1.36 | 2.96 | 0.70 |

*Relative values of the exposure amount (log E) necessary for obtaining a density of fog + 0.10 based on a mercapto compound-free sample.

Furthermore, previously prepared coated samples were left for 3 months in a room at 25° C and 60% RH to examine changes with the lapse of time. Thus, the photographic properties as shown in Table 4 were obtained.

Table 4

| Mercapto Compound | | Fog | Gamma | Maximum Density | Sensitivity* (Δlog E) |
|---|---|---|---|---|---|
| Compound | Amount Added (ml) | | | | |
| — | — | 0.51 | 2.10 | 3.31 | 0.00 |
| | 1 | 0.20 | 2.28 | 3.34 | 0.06 |
| (F2) | 5 | 0.10 | 2.27 | 3.32 | 0.12 |
| | 25 | 0.08 | 2.14 | 3.28 | 0.24 |
| | 1 | 0.21 | 2.16 | 3.27 | 0.11 |
| (2A) | 5 | 0.12 | 1.99 | 3.21 | 0.25 |
| | 25 | 0.08 | 1.72 | 3.09 | 0.49 |
| | 1 | 0.26 | 2.26 | 3.31 | 0.05 |
| (F4) | 5 | 0.18 | 2.27 | 3.31 | 0.11 |
| | 25 | 0.10 | 2.22 | 3.32 | 0.21 |
| | 1 | 0.25 | 2.15 | 3.26 | 0.14 |
| (4A) | 5 | 0.17 | 1.91 | 3.15 | 0.32 |
| | 25 | 0.10 | 1.56 | 2.98 | 0.65 |
| | 1 | 0.18 | 2.30 | 3.32 | 0.06 |
| (F8) | 5 | 0.09 | 2.23 | 3.27 | 0.11 |
| | 25 | 0.07 | 2.04 | 3.25 | 0.22 |
| | 1 | 0.22 | 2.14 | 3.22 | 0.18 |
| (8A) | 5 | 0.12 | 1.79 | 3.06 | 0.40 |
| | 25 | 0.09 | 1.28 | 2.83 | 0.83 |

Relative values of the exposure amount (log E) necessary for obtaining a density of fog + 0.10 based on a mercapto compound-free sample.

From these results, it can be seen that the mercapto compound to be used in the present invention containing a carboxy group shows greater fog-controlling effect as compared with the corresponding compound containing no carboxy group and, surprisingly enough, the reduction in sensitivity accompanying the fog-controlling effect is markedly less and the reduction in gamma and in maximum density is small. This demonstrates the advantages that, in designing light-sensitive materials to be development-processed at an elevated temperature, photographic properties such as sensitivity are not seriously degraded even when the compound is added in the amount necessary for controlling fog and that, as compared with the conventional mercapto compound, the latitude of the amount is widened, which facilitates the designing of light-sensitive materials.

Also, it can be seen that, even when stored for a long period of time under conditions which comparatively well approximate natural conditions, the fog-controlling effect survives without deteriorating the above-described excellent properties.

EXAMPLE 3

100 ml of dioctylbutyl phosphate, 200 ml of ethyl acetate and 5 g of sodium di-(2-ethylhexyl)-α-sulfosuccinate were added to 100 g of Coupler (M-3), 1-(2,6-dichloro-4-methoxyphenyl)-3[(2-chloro-5-tridecanoylamino)anilino]-4-benzenesulfonylamino-5-pyrazolone, and heated to 60° C. The resulting solution was added to 100 ml of an aqueous solution containing 100 g of gelatin and stirred, followed by vigorous mechanical stirring for 30 minutes using a high speed agitator. Thus, the coupler was finely emulsified and dispersed together with the solvent to prepare coupler dispersion (D).

Then, in a manner absolutely the same as described above except for adding as a hydroquinone derivative 15 g of 2,5-di-t-octylhydroquinone (A), coupler dispersion (E) was obtained.

Each of the thus obtained dispersions was added in an amount of 105 g to 100 g of an emulsion containing 6 g of gelatin and comprising $4.0 \times 10^{-2}$ mole of silver bromoiodide (containing 20 mole % chloride) and, after being dissolved, the temperature was adjusted to 35° C. Then, 0.05% aqueous solution of Compound (F9) was added as a mercapto compound in an amount of 0.5 ml, 1 ml, 2 ml, 5 ml or 10 ml and allowed to stand at 35° C for 30 minutes. 15 ml of a 2% aqueous solution of 1-hydroxy-3,5-dichloro-s-triazine sodium salt (as a hardener) was added and finally the pH was adjusted to 6.0. Then, the solution was coated on a cellulose triacetate film support in a coated silver amount of 5.0 mg/100 cm². Further, a solution prepared by adding 45 ml of a 2% aqueous solution of 1-hydroxy-3,5-dichloro-s-triazine sodium salt (as a hardener) to 1000 ml of an aqueous solution containing 30 g of gelatin was coated thereon as a protective layer in a dry thickness of 1.0 μ to prepare color photographic light-sensitive materials.

For comparison, a 0.05% methanol solution of 5-nitro-benzotriazole (Compound (9A)) was added in the above-described amounts in place of the aforesaid mercapto Compound (F9). The coating conditions after the addition were absolutely the same as described above.

The thus obtained photographic light-sensitive materials were subjected to stepwise exposure for sensitometry and to the following processings in order.

| Processing Step | Temperature (° C) | Time (Min.) |
|---|---|---|
| 1. Color Development | 33 | 6 |
| 2. Stopping | " | 2 |
| 3. Washing | " | 2 |
| 4. Bleach-fixing | " | 2 |
| 5. Washing | " | 2 |
| 6. Drying | — | — |

The compositions of the processing solutions used were as follows.

| | |
|---|---|
| Color Developer | |
| Benzyl Alcohol | 12 ml |
| Diethylene Glycol | 3.5 ml |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxyamine Sulfate | 2.0 g |
| Disodium Ethylenediaminetetraacetate (dihydrate) | 2.0 |
| 4-Amino-3-methyl-N-ethyl-N-(β-methanesulfonamidoethyl)aniline Sesquisulfate (monohydrate) | 5.0 g |
| Water to make the total | 1000 ml |
| Stopping Solution | |
| Sodium Thiosulfate | 10 g |
| Ammonium Thiosulfate (70% aq. soln.) | 30 ml |
| Sodium Acetate | 5 g |
| Acetic Acid | 30 ml |
| Potassium Alum | 15 g |
| Water to make the total | 1000 ml |
| Bleach-Fixing Solution | |
| Ferric Sulfate | 20 g |
| Disodium Ethylenediaminetetraacetate (dihydrate) | 36 g |
| Sodium Carbonate (monohydrate) | 17 g |
| Sodium Sulfite | 5 g |
| Ammonium Thiosulfate (70% aq. soln.) | 100 ml |
| Boric Acid | 5 g |

pH was adjusted to 6.8, and water was added thereto to make the total 1000 ml.

After processing, the optical density of these films to green light was measured to obtain the photographic properties as shown in Table 5.

Table 5

| Coupler Dispersion | Compound Added: Compound | Compound Added: Amount Added | Fog | Gamma | Maximum Density | Sensitivity* |
|---|---|---|---|---|---|---|
| | | (ml) | | | | (α log E) |
| (D) | — | — | 0.36 | 2.88 | 3.85 | 0.00 |
| | | 0.5 | 0.14 | 2.97 | 3.86 | 0.05 |
| | | 1.0 | 0.08 | 3.02 | 3.85 | 0.09 |
| (D) | (F9 | 2.0 | 0.06 | 3.03 | 3.87 | 0.15 |
| | | 5.0 | 0.04 | 2.93 | 3.83 | 0.22 |
| | | 10.0 | 0.04 | 2.74 | 3.78 | 0.34 |
| | | 0.5 | 0.13 | 2.94 | 3.80 | 0.08 |
| | | 1.0 | 0.07 | 2.82 | 3.72 | 0.17 |
| (D) | (9A) | 2.0 | 0.05 | 2.51 | 3.56 | 0.39 |
| | | 5.0 | 0.04 | 2.06 | 3.04 | 0.88 |
| | | 10.0 | 0.04 | 1.23 | 2.11 | 1.36 |
| (E) | — | — | 0.22 | 3.13 | 3.84 | 0.07 |
| | | 0.5 | 0.10 | 3.15 | 3.84 | 0.09 |
| | | 1.0 | 0.07 | 3.19 | 3.86 | 0.14 |
| (E) | (F9) | 2.0 | 0.05 | 3.20 | 3.84 | 0.20 |
| | | 5.0 | 0.04 | 3.16 | 3.83 | 0.26 |
| | | 10.0 | 0.04 | 3.08 | 3.78 | 0.38 |
| | | 0.5 | 0.10 | 3.07 | 3.80 | 0.13 |
| | | 1.0 | 0.07 | 2.96 | 3.71 | 0.23 |
| (E) | (9A) | 2.0 | 0.05 | 2.54 | 3.57 | 0.44 |

Table 5-continued

| Coupler Dispersion | Compound Added: Compound | Compound Added: Amount Added | Fog | Gamma | Maximum Density | Sensitivity* |
|---|---|---|---|---|---|---|
| | | 5.0 | 0.04 | 2.07 | 3.05 | 0.91 |
| | | 10.0 | 0.04 | 1.25 | 2.08 | 1.38 |

*Relative values of the exposure amount (log E) necessary for obtaining a density of fog + 0.10 based on a mercapto compound-free sample.

Furthermore, these coated samples were subjected to incubation testing at 40° C, 80% RH, for 2 days to obtain the properties shown in Table 6.

Table 6

Photographic Properties Before and After Incubation

| Coupler Dispersion | Compound Added: Compound | Compound Added: Amount added | Fog | | Gamma | | Maximum Density | | Sensitivity (Δ log E) | |
|---|---|---|---|---|---|---|---|---|---|---|
| | | | Before | After | Before | After | Before | After | Before | After |
| | | (ml) | | | | | | | | |
| (D) | — | — | 0.36 | 0.58 | 2.88 | 2.65 | 3.85 | 3.85 | 0.00 | 0.02 |
| | | 0.5 | 0.14 | 0.16 | 2.97 | 2.93 | 3.86 | 3.85 | 0.05 | 0.06 |
| | | 1.0 | 0.08 | 0.09 | 3.02 | 2.99 | 3.85 | 3.86 | 0.09 | 0.09 |
| (D) | (F9) | 2.0 | 0.06 | 0.06 | 3.03 | 3.01 | 3.87 | 3.88 | 0.15 | 0.16 |
| | | 5.0 | 0.04 | 0.04 | 2.93 | 2.90 | 3.83 | 3.84 | 0.22 | 0.23 |
| | | 10.0 | 0.04 | 0.04 | 2.74 | 2.72 | 3.78 | 3.77 | 0.34 | 0.34 |
| | | 0.5 | 0.13 | 0.15 | 2.94 | 2.90 | 3.80 | 3.78 | 0.08 | 0.09 |
| | | 1.0 | 0.07 | 0.08 | 2.82 | 2.77 | 3.72 | 2.63 | 0.17 | 0.19 |
| (D) | (9A) | 2.0 | 0.05 | 0.05 | 2.51 | 2.45 | 3.56 | 3.39 | 0.39 | 0.43 |
| | | 5.0 | 0.04 | 0.04 | 2.06 | 1.98 | 3.04 | 2.84 | 0.88 | 0.95 |
| | | 10.0 | 0.04 | 0.04 | 1.23 | 1.06 | 2.11 | 1.75 | 1.36 | 1.46 |
| (E) | — | — | 0.22 | 0.36 | 3.13 | 3.03 | 3.84 | 3.83 | 0.07 | 0.11 |
| | | 0.5 | 0.10 | 0.12 | 3.15 | 3.12 | 3.84 | 3.85 | 0.09 | 0.13 |
| | | 1.0 | 0.07 | 0.09 | 3.19 | 3.15 | 3.86 | 3.85 | 0.14 | 0.16 |
| (E) | (F9) | 2.0 | 0.05 | 0.05 | 3.20 | 3.14 | 3.84 | 3.83 | 0.20 | 0.21 |
| | | 5.0 | 0.04 | 0.04 | 3.16 | 3.09 | 3.83 | 3.81 | 0.26 | 0.28 |
| | | 10.0 | 0.04 | 0.04 | 3.08 | 2.96 | 3.78 | 3.77 | 0.38 | 0.42 |
| | | 0.5 | 0.10 | 0.11 | 3.07 | 3.02 | 3.80 | 3.76 | 0.13 | 0.17 |
| | | 1.0 | 0.07 | 0.08 | 2.96 | 2.91 | 3.71 | 3.60 | 0.23 | 0.26 |
| (E) | (9A) | 2.0 | 0.05 | 0.06 | 2.54 | 2.44 | 3.57 | 3.39 | 0.44 | 0.48 |
| | | 5.0 | 0.04 | 0.04 | 2.07 | 1.87 | 3.05 | 2.84 | 0.91 | 0.98 |
| | | 10.0 | 0.04 | 0.04 | 1.25 | 1.05 | 2.08 | 1.72 | 1.38 | 1.50 |

*Relative values of the exposure amount (log E) necessary for obtaining a density of fog + 0.10 based on a mercapto compound-free, fresh sample.

These results show that the mercapto compound and the magenta 2-equivalent coupler to be used in combination in the present invention also provide satisfactory anti-fogging effects. Also, these results demonstrate that, as compared with 5-nitrobenzotriazole conventionally well known, the reduction in sensitivity and the reduction in gamma are less and excellent properties can be obtained. Further, these results demonstrate that, even under the severe conditions of incubation at high temperature and under high humidity, sufficient properties can be achieved and the combination has the advantage that the excellent advantages can be maintained with scarcely no change from the properties before incubation.

Furthermore, in the combined use with the hydroquinone derivative, it can be seen that additional effects of the excellent properties of both compounds are shown, i.e., the color stain-preventing effect of the hydroquinone derivative and the anti-fogging effect of the mercapto compounds.

EXAMPLE 4

100 g of Coupler (M-8), 1-(2,4-dimethyl-6-chlorophenyl)-3-[(2-chloro-5-tetradecanoylamino)anilino]-5-pyrazolone, 100 ml of tricresyl phosphate, 200 ml of ethyl acetate and 5 g of sodium p-dodecylbenzenesulfonate were heated to 60° C, and the resulting solution was added to 100 ml of an aqueous solution containing 100 g of gelatin, followed by vigorous mechanical stirring for 30 minutes using a high speed agitator to finely emulsify and disperse the coupler together with the solvent to obtain coupler dispersion (F).

Then, in the same manner as described above except for adding as a hydroquinone derivative 20 g of hexadecylhydroquinone (B), fine coupler dispersion (G) was obtained.

Each of the thus obtained dispersion was added in an amount of 35.3 g to 100 g of an emulsion containing 7 g of gelatin and comprising $3.5 \times 10^{-2}$ mole of silver bromoiodide (containing 2 mole % iodide) and, after being dissolved, the temperature was adjusted to 35° C. Then, a $1 \times 10^{-3}$ mole methanol solution of Compound (F 16) was added as a mercapto compound in an amount of 0.35 ml, 1.0 ml, 3.5 ml or 10.0 ml and the mixture was allowed to stand at 35° C for 30 minutes. 10 ml of a 2% aqueous solution of 1-hydroxy-3,5-dichloro-s-triazine sodium salt (as a hardener) was added and finally the pH was adjusted to 6.0. Then, the solution was coated on a cellulose triacetate film support in a coated silver amount of 11.0 mg/100 cm². Further, a solution prepared by adding 45 ml of a 2% aqueous solution of 1-hydroxy-3,5-di-chloro-s-triazine sodium salt (as a hardener) to 1000 ml of an aqueous solution containing 30 g of gelatin was coated thereon as a protective layer in a dry thickness of 1.0 μ to prepare color photographic light-sensitive materials.

For comparison, a $1 \times 10^{-3}$ methanol solution of mercapto-thiadiazole (Compound (16A) was added in the above-described amounts in place of the above mercapto Compound (F 16). The coating conditions after the addition were absolutely the same as described above.

The thus obtained photographic light-sensitive materials were subjected to stepwise exposure for sensitometry and to the following processings in order.

| Processing Step | Temperature (° C) | Time (min) |
|---|---|---|
| 1. Color Development | 38 | 4 |
| 2. Stopping | " | 1 |
| 3. Washing | " | 1 |
| 4. Bleaching | " | 1.5 |
| 5. Washing | " | 1 |
| 6. Fixing | " | 1.5 |
| 7. Washing | " | 4 |
| 8. Drying | — | — |

The color developer and the stopping solution as described in Example 3 were used and the other processing solution had the following compositions.

| | |
|---|---|
| Bleaching Solution | |
| Potassium Ferricyanide | 20 g |
| Potassium Bromide | 5 g |
| Borax (decahydrate) | 10 g |
| Boric Acid | 7 g |
| Water to make the total | 1000 ml |
| Fixing Solution | |
| Sodium Thiosulfate | 60 g |
| Sodium Sulfite | 5 g |
| Sodium Carbonate (monohydrate) | 3 g |
| Sodium Bicarbonate | 10 g |
| Water to make the total | 1000 ml |

After processing, the optical density of these films to green light was measured to obtain the photographic properties as shown in Table 7.

Table 7

| Coupler Dispersion | Compound Added: Compound | Compound Added: Amount Added | Fog | Gamma | Maximum | Sensitivity * |
|---|---|---|---|---|---|---|
| | | (ml) | | | | (Δ log E) |
| (F) | — | — | 0.28 | 2.15 | 2.62 | 0.00 |
| | | 0.35 | 0.11 | 2.31 | 2.62 | 0.03 |
| (F) | (F16) | 1.0 | 0.06 | 2.36 | 2.63 | 0.07 |
| | | 3.5 | 0.04 | 2.35 | 2.62 | 0.16 |
| | | 10.0 | 0.03 | 2.17 | 2.60 | 0.28 |
| | | 0.35 | 0.13 | 2.19 | 2.60 | 0.07 |
| (F) | (16A) | 1.0 | 0.08 | 2.08 | 2.54 | 0.19 |
| | | 3.5 | 0.05 | 1.93 | 2.41 | 0.52 |
| | | 10.0 | 0.04 | 1.64 | 2.18 | 1.05 |
| (G) | — | — | 0.18 | 2.35 | 2.61 | 0.05 |
| | | 0.35 | 0.08 | 2.40 | 2.61 | 0.07 |
| (G) | (F16) | 1.0 | 0.05 | 2.44 | 2.62 | 0.10 |
| | | 3.5 | 0.04 | 2.46 | 2.62 | 0.18 |
| | | 10.0 | 0.03 | 2.28 | 2.60 | 0.31 |
| | | 0.35 | 0.09 | 2.31 | 2.59 | 0.11 |
| (G) | (16A) | 1.0 | 0.06 | 2.23 | 2.52 | 0.24 |
| | | 3.5 | 0.05 | 2.02 | 2.40 | 0.56 |
| | | 10.0 | 0.04 | 1.76 | 2.19 | 1.09 |

*Relative value of the difference of the exposure amount (log E) necessary for obtaining a density of fog + 0.10 based on that of a mercapto compound-free sample.

Then, these coated samples were stored for 3 months in a room at 25° C and 60% relative humidity to test storability with the lapse of time to obtain the photographic properties as shown in the following Table 8.

Table 8

Photographic Properties Before and After Storage

| Coupler Dispersion | Compound Added: Compound | Compound Added: Amount added | Fog: Before | Fog: After | Gamma: Before | Gamma: After | Maximum Density: Before | Maximum Density: After | Sensitivity (Δ log E): Before | Sensitivity (Δ log E): After |
|---|---|---|---|---|---|---|---|---|---|---|
| | | (ml) | | | | | | | | |
| (F) | — | — | 0.28 | 0.32 | 2.15 | 2.06 | 2.62 | 2.62 | 0.00 | 0.02 |
| | | 0.35 | 0.11 | 0.13 | 2.31 | 2.30 | 2.62 | 2.62 | 0.03 | 0.05 |
| (F) | (F16) | 1.0 | 0.06 | 0.06 | 2.36 | 2.35 | 2.63 | 2.62 | 0.07 | 0.06 |
| | | 3.5 | 0.04 | 0.04 | 2.35 | 2.35 | 2.62 | 2.63 | 0.16 | 0.16 |
| | | 10.0 | 0.03 | 0.03 | 2.17 | 2.15 | 2.60 | 2.60 | 0.28 | 0.28 |
| | | 0.35 | 0.13 | 0.14 | 2.19 | 2.18 | 2.60 | 2.58 | 0.07 | 0.09 |
| (F) | (16A) | 1.0 | 0.08 | 0.08 | 2.08 | 2.01 | 2.54 | 2.50 | 0.19 | 0.21 |
| | | 3.5 | 0.05 | 0.05 | 1.93 | 1.82 | 2.41 | 2.31 | 0.52 | 0.55 |
| | | 10.0 | 0.04 | 0.03 | 1.64 | 1.44 | 2.81 | 2.02 | 1.05 | 1.13 |
| (G) | — | — | 0.18 | 0.23 | 2.35 | 2.27 | 2.61 | 2.60 | 0.05 | 0.07 |
| | | 0.35 | 0.08 | 0.09 | 2.40 | 2.38 | 2.61 | 2.61 | 0.07 | 0.08 |
| (G) | (F16) | 1.0 | 0.05 | 0.05 | 2.44 | 2.41 | 2.62 | 2.61 | 0.10 | 0.12 |
| | | 3.5 | 0.04 | 0.04 | 2.46 | 2.45 | 2.62 | 2.62 | 0.18 | 0.19 |
| | | 10.0 | 0.03 | 0.03 | 2.28 | 2.27 | 2.60 | 2.60 | 0.31 | 0.31 |
| | | 0.35 | 0.09 | 0.17 | 2.31 | 2.22 | 2.59 | 2.57 | 0.11 | 0.14 |
| (G) | (16A) | 1.0 | 0.06 | 0.07 | 2.23 | 2.14 | 2.52 | 2.46 | 0.24 | 0.26 |
| | | 3.5 | 0.05 | 0.05 | 2.02 | 2.90 | 2.40 | 2.28 | 0.56 | 0.60 |

Table 8-continued

| Photographic Properties Before and After Storage | | | | | | | | | | |
|---|---|---|---|---|---|---|---|---|---|---|
| Compound Added | | | Fog | | Gamma | | Maximum Density | | Sensitivity (Δ log E) | |
| Coupler Dispersion | Compound | Amount added | Before | After | Before | After | Before | After | Before | After |
| | | 10.0 | 0.04 | 0.03 | 1.76 | 1.59 | 2.19 | 1.99 | 1.09 | 1.17 |

*Relative value of the difference of the exposure amount (log E) necessary for obtaining a density of fog + 0.10 based on that of a mercapto compound-free, fresh sample.

The above-described results markedly show the anti-fogging effect of the combination of the mercapto compound and the highly active magenta coupler to be used in the present invention. It is clear that the amino group-containing mercapto compound shows excellent effects without reduction in sensitivity which would result accompanying the anti-fogging effects. Also, it can be seen that sufficient anti-fogging effects can be obtained even upon long storage.

Further, in the combined use with the hydroquinone derivative, it is clear that color photographic light-sensitive materials can be provided in which the excellent properties of both compounds are maintained, in which the additional property of the color stain-preventing effect of the hydroquinone derivative and the anti-fogging effect of the mercapto compound can be obtained and which has superior properties as compared with that wherein the mercapto compound is used alone.

While the invention has been described in detail and with reference to specific embodiments thereof, it will be apparent to one skilled in the art that various changes and modifications ca be made therein without departing from the spirit and scope thereof.

What is claimed is:

1. A color photographic light-sensitive material comprising a silver halide photographic emulsion containing (1) at least one compound selected from the group consisting of (a) a compound represented by the following formulae (III), (IVa) or (IVb);

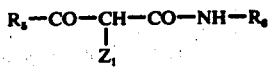

(III)

wherein $R_5$ represents a primary, secondary or tertiary substituted or unsubstituted alkyl group having one to eighteen carbon atoms or a substituted ur unsubstituted aryl group, and $R_6$ represents a substituted or unsubstituted aryl group;

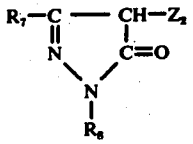

(IVa)

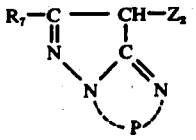

(IVb)

wherein R represents the atoms necessary to complete a heterocyclic ring, $R_7$ and $R_8$ each represents one of the same groups as defined for $R_5$ or is an alkoxy group having 1 to 18 carbon atoms, a heterocyclic ring, an alkoxy carbonyl group, and aryloxycarbonyl group, an aralkylthio group, an arylthio group, a carboxy group, an acylamino group, a diacylamino group and N-alkylacylamino group, an N-arylacylamino group, a ureido group, a thioureido group, an alkoxycarbonylamino group, an aryloxycarbonylamino group, an alkoxythiocarbonylamino group, an aryloxythiocarbonylamino group, an anilino group, an alkylamino group, a cycloamino group, an alkylcarbonyl group, an arylcarbonyl group, a sulfonamido group, a carboamoyl group, a sulfamoyl group, a guanidino group, a cyano group, an acyloxy group, a sulfonyloxy group, a hydroxy group, a mercapto group, a halogen atom, or sulfo group, and wherein $Z_1$ and $Z_2$ represent the formulae (Ia), (Ib) or (Ic):

| | |
|---|---|
| $-NHR_1$ | (Ia) |
| $-NR_2R_3$ | (Ib) |
| $-N=N-R_4$ | (Ic) |

wherein $R_1$ represents an acyl group, a halogenated alkyl group having up to three carbon atoms or a halogenated phenyl group, $R_2$ and $R_3$, which may be the same or different, each represents one of the same groups as $R_1$ or can be combined together with the nitrogen atom of the coupling-off group to form a heterocyclic residue, $R_4$ represents one of the same groups as defined for $R_1$ or represents an unsubstituted or substituted aryl group, and (b) a 4-position unsubstituted 3-arylamino-5-pyrazolone derivative, and (2) at least one compound represented by the following general formula (II);

Q—SH (II)

wherein Q represents a 5-or 6-membered ring containing at least one of N, O, S or Se as a hetero atoma with the —SH moiety attached to a carbon atom of the ring and having directly or indirectly bonded thereto at least one of a $-SO_3H$ group, a —COOH group, an —OH group and a —NHR group, where R represents a hydrogen atom or an alkyl group having 1 to 6 carbon atoms.

2. The color photographic light-sensitive material as described in claim 1, wherein said coupler is said 3-arylamino-5-pyrazolone derivative.

3. The color photographic light-sensitive material as described in claim 1, wherein said coupler is a compound wherein a heterocyclic ring selected from the group consisting of imidazolidine, oxazolidine, piperidine, morpholine and benzimidazole is conected to the carbon atom of the active methylene group through the nitrogen atom of said ring.

4. The color photographic light-sensitive material as described in claim 1, wherein said coupler is a compound wherein one hydrogen atom of the active methylene group is substituted with a sulfoamido group.

5. The color photographic light-sensitive material as described in claim 1, wherein said coupler is a compound wherein a succinimido or phthalimido group is connected to the carbon atom of the active methylene group.

6. The color photographic light-sensitive material as described in claim 1, wherein said coupler is a compound wherein one hydrogen atom of the active methylene group is substituted with an α-haloacylamido group.

7. The color photographic light-sensitive material as described in claim 2, wherein said compound of the general formula (II) is a heterocyclic ring containing mercapto compound having a sulfo group.

8. The color photographic light-sensitive material as described in claim 3, wherein said compound of the general formula (II) is a heterocylic ring containing mercapto compound having a sulfo group.

9. The color photographic light-sensitive material as described in claim 4, wherein said compound of the general formula (II) is a heterocyclic ring containing mercapto compound having a sulfo group.

10. The color photographic light-sensitive material as described in claim 5, wherein said compound of the general formula (II) is a heterocyclic ring containing mercapto compound having a sulfo group.

11. The color photographic light-sensitive material as described in claim 6, wherein said compound of the general formula (II) is a heterocylic ring containing mercapto compound having a sulfo group.

12. The color photographic light-sensitive material as described in claim 2, wherein said compound of the general formula (II) is 5-sulfo-2-mercaptobenzimidazole or 5-sulfo-2-mercaptobenzothiazole.

13. The color photographic light-sensitive material as described in claim 3, wherein said compound of the general formula (II) is 5-sulfo-2-mercaptobenzimidazole or 5-sulfo-2-mercaptobenzothiazole.

14. The color photographic light-sensitive material as described in claim 4, wherein said compound of the general formula (II) is 5-sulfo-2-mercaptobenzimidazole or 5-sulfo-2-mercaptobenzothiazole.

15. The color photographic light-sensitive material as described in claim 5, wherein said compound of the general formula (II) is 5-sulfo-2-mercaptobenzimidazole or 5-sulfo-2-mercaptobenzothiazole.

16. The color photographic light-sensitive material as described in claim 6, wherein said compound of the general formula (II) is 5-sulfo-2-mercaptobenzimidazole or 5-sulfo-2-mercaptobenzothiazole.

17. The color photographic light-sensitive material as described in claim 2, wherein said compound of the general formula (II) is a heterocyclic ring containing mercapto compound having a carboxy group.

18. The color photographic light-sensitive material as described in claim 3, wherein said compound of the general formula (II) is a heterocyclic ring containing mercapto compound having a carboxy group.

19. The color photographic light-sensitive material as described in claim 4, wherein said compound of the general formula (II) is a heterocyclic ring containing mercapto compound having a carboxy group.

20. The color photographic light-sensitive material as described in claim 5, wherein said compound of the general formula (II) is a heterocyclic ring containing mercapto compound having a carboxy group.

21. The color photographic light-sensitive material as described in claim 6, wherein said compound of the general formula (II) is a heterocyclic ring containing mercapto compound having a carboxy group.

22. The color photographic light-sensitive material as described in claim 2, wherein said compound of the general formula (II) is 5-hydroxy-2-mercaptobenzothiazole.

23. The color photographic light-sensitive material as described in claim 3, wherein said compound of the general formula (II) is 5-hydroxy-2-mercaptobenzothiazole.

24. The color photographic light-sensitive material as described in claim 4, wherein said compound of the general formula (II) is 5-hydroxy-2-mercaptobenzothiazole.

25. The color photographic light-sensitive material as described in claim 5, wherein said compound of the general formula (II) is 5-hydroxy-2-mercaptobenzothiazole.

26. The color photographic light-sensitive material as described in claim 6, wherein said compound of the general formula (II) is 5-hydroxy-2-mercaptobenzothiazole.

27. The color photographic light-sensitive material as described in claim 2, wherein said compound of the general formula (II) is a heterocyclic ring containing mercapto compound having an amino group.

28. The color photographic light-sensitive material as described in claim 3, wherein said compound of the general formula (II) is a heterocyclic ring containing mercapto compound having an amino group.

29. The color photographic light-sensitive material as described in claim 4, wherein said compound of the general formula (II) is a heterocyclic ring containing mercapto compound having an amino group.

30. The color photographic light-sensitive material as described in claim 5, wherein said compound of the general formula (II) is a heterocyclic ring containing mercapto compound having an amino group.

31. The color photographic light-sensitive material as described in claim 6, wherein said compound of the general formula (II) is a heterocyclic ring containing mercapto compound having an amino group.

32. The color photographic light-sensitive material as described in claim 2, wherein said compound of the general formula (II) is 2-mercapto-5-amino-1,3,4-thiadiazole.

33. The color photographic light-sensitive material as described in claim 3, wherein said compound of the general formula (II) is 2-mercapto-5-amino-1,3,4-thiadiazole.

34. The color photographic light-sensitive material as described in claim 4, wherein said compound of the general formula (II) is 2-mercapto-5-amino-1,3,4-thiadiazole.

35. The color photographic light-sensitive material as described in claim 5, wherein said compound of the general formula (II) is 2-mercapto-5-amino-1,3,4-thiadiazole.

36. The color photographic light-sensitive material as described in claim 6, wherein said compound of the general formula (II) is 2-mercapto-5-amino-1,3,4-thiadiazole.

37. The color photographic light-sensitive material as described in claim 1, wherein said emulsion contains (1) said 3-arylamino-5-pyrazolone or a 2-equivalent magenta or yellow coupler wherein one hydrogen atom of the active methylene group of said coupler is substituted with a nitrogen atom, (2), said mercapto heterocyclic ring containing compound of the formula (II), and (3) a hydroquinone compound of the formula (VI)

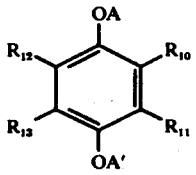

(VI)

wherein A and A' each represents a hydrogen atom or a group capable of being eliminated by an alkali, each having up to 18 carbon atoms, $R_{10}$, $R_{11}$, $R_{12}$ and $R_{13}$ each represents a hydrogen atom, an alkyl group having 20 or less carbon atoms, an alkenyl group having 20 or less carbon atoms, an alkylthio group having 20 or less carbon atoms, an alkoxy group having 8 or less carbon atoms, a halogen atom, an aryl group, a hydroxy group, an arylthio group, a heterocyclic ring thio group, or a heterocyclic ring, provided that at least one of $R_{10}$ through $R_{13}$ is an alkyl, alkenyl or alkylthio group having 8 to 20 carbon atoms and that the number of alkyl, alkenyl or alkylthio groups does not exceed 2, or the o-acyl derivative of said hydroquinone compound.

38. The color photographic light sensitive material as described in claim 1, wherein Q is at least one heterocyclic ring selected from the group consisting of a triazole ring, a tetrazole ring, a thiadiazole ring, a benzothiazole ring, a benzimidazole ring, a benzoxazole ring and a benzoselenzole ring.

39. The color photographic light sensitive material as described in claim 1, wherein said compound of formula II is 2-mercapto-5-sulfo benzimidazole or 2-mercapto-5-hydroxyethyl-1,3,4-thiadiazole.

40. The color photographic light sensitive material as described in claim 1, wherein said compound of formula II is selected from the group consisting of:

(F-1)
2-Mercapto-5-sulfo-benzimidazole,
(F-2)
2-Mercapto-5-carboxy-benzothiazole,
(F-3)
2-Mercapto-5-carboxy-benzoselenazole,
(F-4)
2-Mercapto-7-carboxy-benzoxazole,
(F-5)
2-Mercapto-1-sulfopropyl-5-chlorobenzimidazole,
(F-6)
1-Sulfophenyl-5-mercapto-tetrazole,
(F-7)
2-Mercapto-5-sulfobutylthio-thiodiazole,
(F-8)
2-Mercapto-5-carboxy-benzimidazole,
(F-9)
2-Mercapto-5-sulfo-benzothiazole,
(F-10)
2-Mercapto-5-carboxy-benzoxazole,
(F-11)
2-Mercapto-1-hydroxyethyl-benzimidazole,
(F-12)
2-Mercapto-4-carboxyethyl-imidazole,
(F13)
4-Sulfophenyl-3-mercapto-1,2,4-triazole,
(F-14)
2-Mercapto-5-sulfo-6,7-benzoxazole,
(F-15)
2-Mercapto-7-sulfo-5,6-benzoxazole,
(F-16)
2-Mercapto-5-amino-1,3,4-thiadiazole, and
(F-17)
2-Mercapto-5-hydroxyethyl-1,3,4-thiadiazole.

* * * * *